US011154165B1

(12) United States Patent
Norris

(10) Patent No.: US 11,154,165 B1
(45) Date of Patent: Oct. 26, 2021

(54) PORTABLE WASHING STATION

(71) Applicant: Anthony Norris, Orange Park, FL (US)

(72) Inventor: Anthony Norris, Orange Park, FL (US)

( * ) Notice: Subject to any disclaimer, the term of this patent is extended or adjusted under 35 U.S.C. 154(b) by 21 days.

(21) Appl. No.: 16/841,872

(22) Filed: Apr. 7, 2020

(51) Int. Cl.
*A47K 1/02* (2006.01)
*A47K 5/02* (2006.01)
*A47K 10/18* (2006.01)

(52) U.S. Cl.
CPC ..... *A47K 1/02* (2013.01); *A47K 5/02* (2013.01); *A47K 10/18* (2013.01); *A47K 2210/00* (2013.01)

(58) Field of Classification Search
CPC . A47K 1/02; A47K 5/02; A47K 10/18; A47K 2210/00
USPC ..... 4/625, 626, 616, 617
See application file for complete search history.

(56) References Cited

U.S. PATENT DOCUMENTS 1,577,038 A * 3/1926 Kvitle ..... A47K 3/285 4/617
5,465,878 A 11/1995 Armijo
6,049,919 A * 4/2000 Roteman ..... A47K 3/285 4/616
9,585,522 B1 3/2017 Brown, Sr.
2005/0284889 A1* 12/2005 DuBois ..... A47K 1/02 222/192
2014/0332618 A1* 11/2014 McNicholas ..... A47K 10/22 242/591
2018/0140142 A1* 5/2018 Aich ..... A47K 1/02

* cited by examiner

*Primary Examiner* — Tuan N Nguyen
(74) *Attorney, Agent, or Firm* — Sanchelima & Associates, P.A.; Christian Sanchelima; Jesus Sanchelima

(57) ABSTRACT

A system for a washing station including a water reservoir assembly, a holder assembly and a soap dispenser assembly is disclosed. There is a water reservoir that holds clean water that can be used for washing, cleaning, drinking or cooking as necessary by a user. The water within the water reservoir is dispensed through a spigot mounted to the water reservoir. The spigot can be turned on and off to allow the water to be dispensed as needed. The water reservoir may include a lid for maintaining the water within the water reservoir clean. Atop of the lid may be a holder for holding a paper roll readily available for the user to be able to dry their hands after washing. There may also be a soap dispenser mounted to the water reservoir which allows for the thorough cleaning of the hands of the user to rid of bacteria.

12 Claims, 5 Drawing Sheets

PORTABLE WASHING STATION

II. BACKGROUND OF THE INVENTION

1. Field of the Invention

The present invention relates to a washing station and, more particularly, to a washing station that is portable and allows a user to quickly and conveniently have access to water for washing, cleaning, drinking or cooking even outdoors.

2. Description of the Related Art

Several designs for portable washing stations have been designed in the past. None of them, however, include a hand washing station comprising a portable water reservoir having a pair of spigots with a holder for paper product rolls. Importantly, the hand washing station may be portable. This allows a user to be able to wash their hands even when in inconvenient locations such as the outdoors. Further, the hand washing station is easy to transport. It was even be possible to use the water stored within the portable hand washing station for drinking or cooking should the user have those needs.

Applicant believes that a related reference corresponds to U.S. Pat. No. 9,585,522 for a portable hand washing station which includes a spigot on a front side of the cart. Applicant believes another related reference corresponds to U.S. Pat. No. 5,465,878 for a water caddy which includes a spout for dispensing the water out of a housing, so that the water can be used for washing and drinking. None of these, references, however, teach of the hand washing station having a portable water reservoir with a pair of spigots and a paper roll holder.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a washing station that is portable.

It is another object of this invention to provide a washing station that can be used in inconvenient locations where water is not readily accessible.

It is still another object of the present invention to provide a washing station that houses water for washing, cleaning, cooking, drinking or the like.

It is another object of the present invention to provide a portable washing station that can be easily and quickly refilled with liquids such as water.

It is an object of the present invention to provide a portable washing station that can be customized by the user to allow the user to express their creativity.

It is also an object of the present invention to provide a portable washing station that can be customized by the user to allow the user to improve the atheistic appeal of the present invention.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Figure 1:
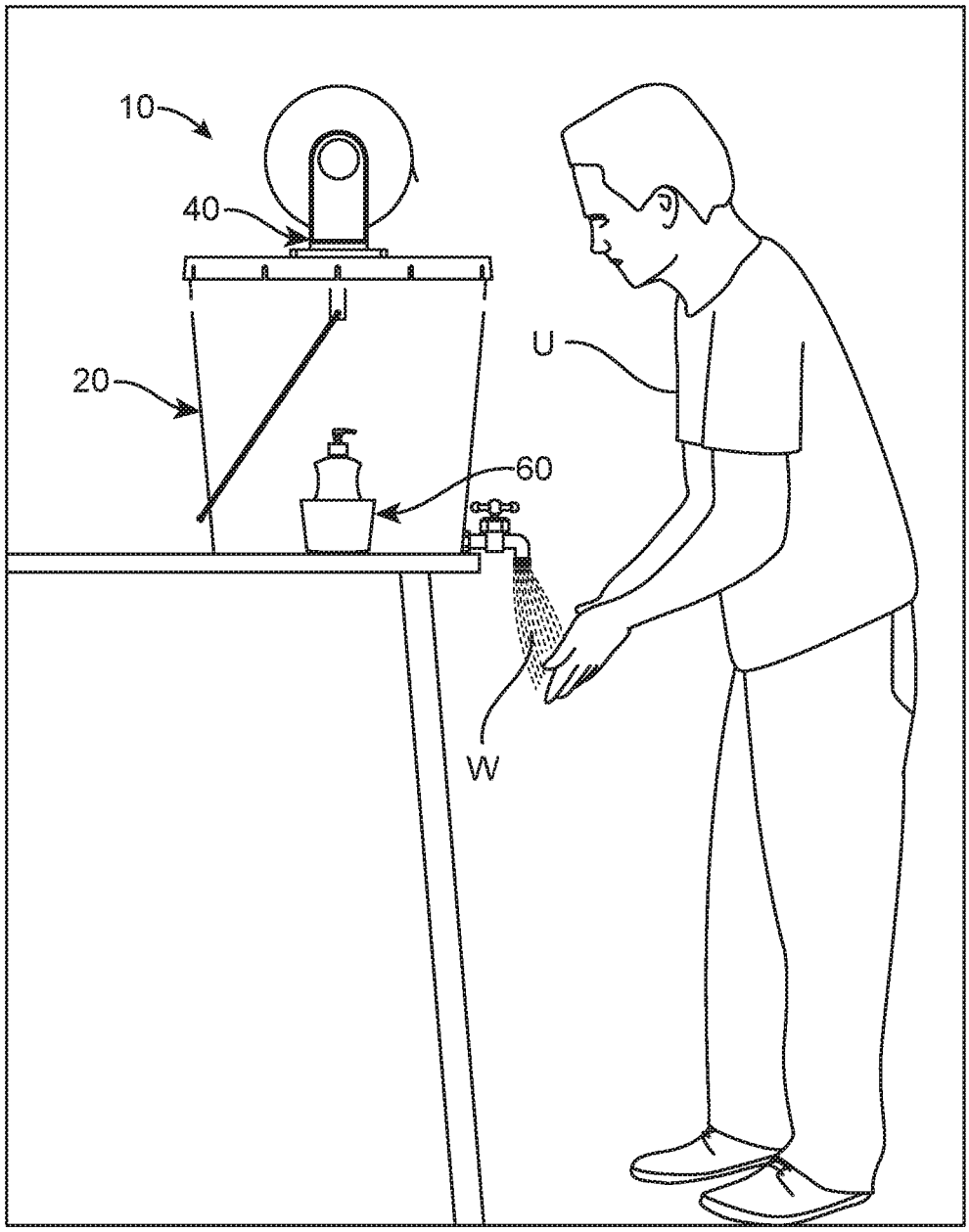
FIG. 1 represents the present invention in an operational setting in which a user is washing their hands outdoors.
Figure 2:
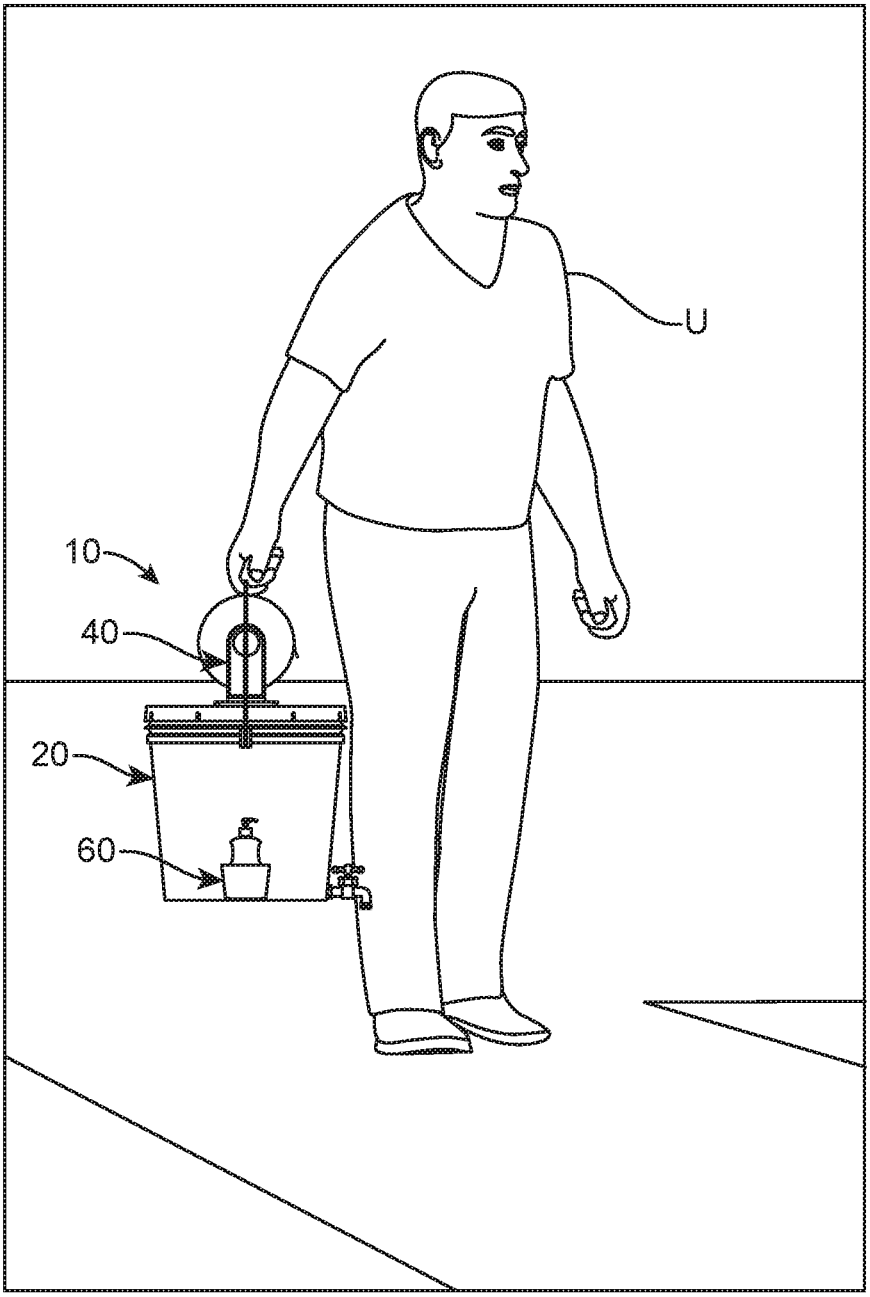
FIG. 2 shows the present invention being transported by a user to illustrate the portability of the present invention.

Referring now to the drawings, where the present invention is generally referred to with numeral 10, it can be observed that it, a washing station 10, basically includes a water reservoir assembly 20, a holder assembly 40 and a soap dispenser assembly 60.

Referring to FIGS. 1-5 it can be seen that washing station 10 is depicted in the immediate embodiment. Washing station 10 may be portable for ease of transporting the present invention to locations that may be inconvenient, such as the outdoors, where clean water may not be readily accessible otherwise. The portability of the present invention further allows for the hand washing station to be easily carried by a user U regardless of age. With the present invention being capable of being transported to virtually any location clean water for washing, cleaning, cooking or drinking may be readily available to user U more easily. This helps to improve the comfort of user U being that water W and more specifically clean water is crucial. Referring to FIG. 1, it can be seen how user U makes use of the present invention in order to wash their hands. Now referring to FIG. 2, it can be seen how washing station 10 may be easily transported to have it at a desired location.

Figure 3:
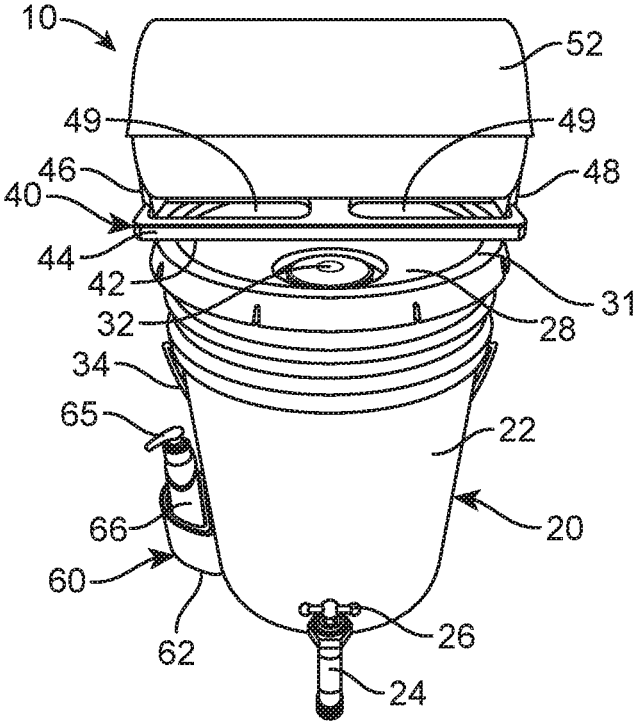
FIG. 3 shows an isometric view of the present invention with the toilet paper roll attached.
Figure 4:
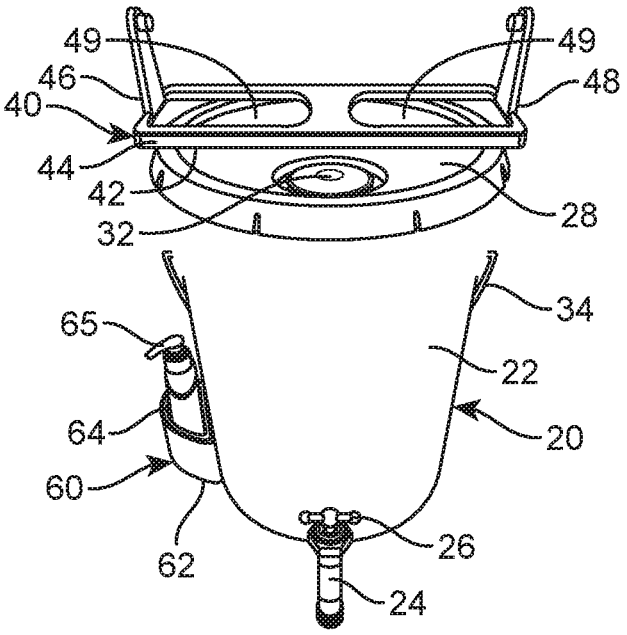
FIG. 4 illustrates an isometric view of the present invention without the paper towel roll attached.

Referring to FIG. 3, it can be seen how washing station 10 includes water reservoir assembly 20. Within water reservoir assembly 20 is where water W may be stored. Importantly, water reservoir assembly 20 includes water reservoir 22 for holding and storing of water W. In one embodiment, water reservoir 22 may be cylindrical in shape. However, it should be understood that water reservoir 22 may be of a predetermined shape and dimensions. It should be understood that the greater the dimensions of water reservoir 22 are the more of water W may be stored within the present invention. Water reservoir 22 may serve as a tank, bucket or the like for water W. As such, water reservoir 22 may have a closed bottom and an open top, in one embodiment. In one embodiment, water reservoir 22 may be made of a material that insulates to be able to maintain the temperate of water W constant for a predetermined amount of time. Mounted to water reservoir 22 at a predetermined location may be a spigot 24 with a spigot knob 26 for dispensing water W.

Spigot 24 may protrude from water reservoir 24. In one embodiment, spigot 24 may be mounted about the perimeter of water reservoir 22. It may be suitable for spigot 24 to be located at a lower portion of water reservoir 22. Spigot knob 26 may be adapted to turn on and off spigot 24 to allow or prevent, respectively, the flow of water W out from water reservoir 22. Spigot knob 26 may be turned a predetermined amount in a predetermined direction to allow water W out through spigot 24 and in an opposite direction to stop water W from being dispensed. It may be suitable to let water W flow freely to wash the hands of user U, for example. With water W that is flowing or dispensed, user U may wash their hands or alternatively to clean or cook with water W. It may also be suitable for user U to drink water W.

Water reservoir 22 may further include a lid 28 at a top end thereof. Lid 28 may be removably mounted to water reservoir 22. Lid 28 may be adapted to cover an opening 29 of water reservoir 22. Opening 29 may lead to an interior of water reservoir 22, where water W may be stored. Lid 28 may entirely cover opening 29. Lid 28 may be of a shape and dimension that cooperates with water reservoir 22 and opening 29 to allow for secure attaching of lid 28. It can be seen that lid 28 may extend beyond the perimeter of water reservoir 22. Lid 28 may partially extend downwardly on water reservoir 22 when attached. It can also be seen that lid 28 may include a lip 31 about the perimeter of lid 28. The top surface of lid 28 may be recessed a predetermined distance below lip 31 of lid 28. In one embodiment, the top surface of lid 28 may extend between lip 31 of lid 28. Lid 28 may include a refill lid 32 that covers a refill opening 33. Refill lid 32 may be removed from lid 28 to allow refill opening 33 to become exposed. Refill opening 33 may be used to refill water reservoir 22, with preferably water W, after it has emptied. Refill lid 32 and refill opening 33 may allow for water reservoir 22 to be refill even while lid 28 is still attached to water reservoir. Refill lid 32 and refill opening 33 may provide an alternate way to access the interior of water reservoir 22. In one embodiment, refill lid 32 and refill opening 33 may be circular. However, it should be understood that refill lid 32 and refill opening 33 may be of a predetermined shape and dimensions. Refill lid 32 may be of a shape and dimension that cooperates with entirely covering refill opening 33. Water reservoir 22 may have an open configuration when opening 29 is not covered by lid 28. The closed configuration is achieved when lid 28 is detached from water reservoir 22. Water reservoir 22 may have a closed configuration when opening 29 is covered by lid 28. The closed configuration is achieved when lid 28 is attached to water reservoir 22.

Figure 5:
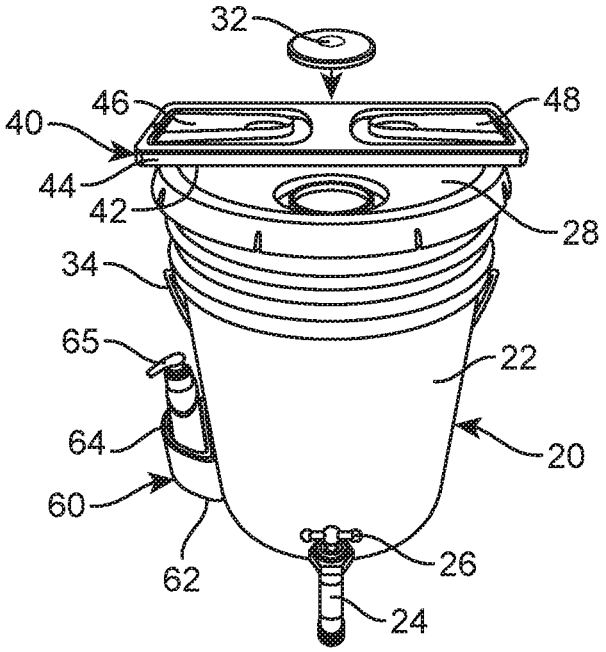
FIG. 5 represents an isometric view of the present invention with the holder assembly being stored.
Figure 6:
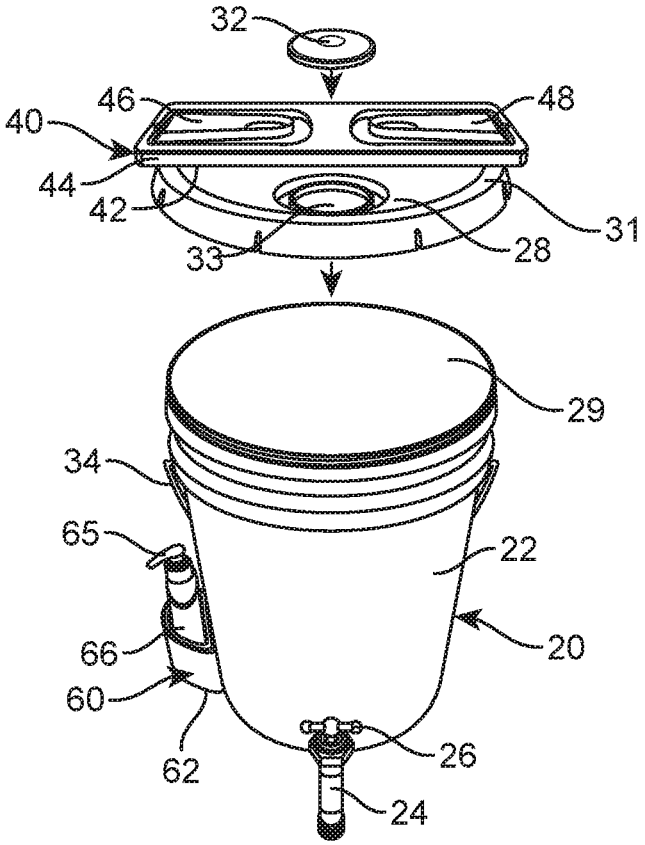
FIG. 6 illustrates an isometric view of the present invention with the lid and the refill lid detached.
Figure 7:
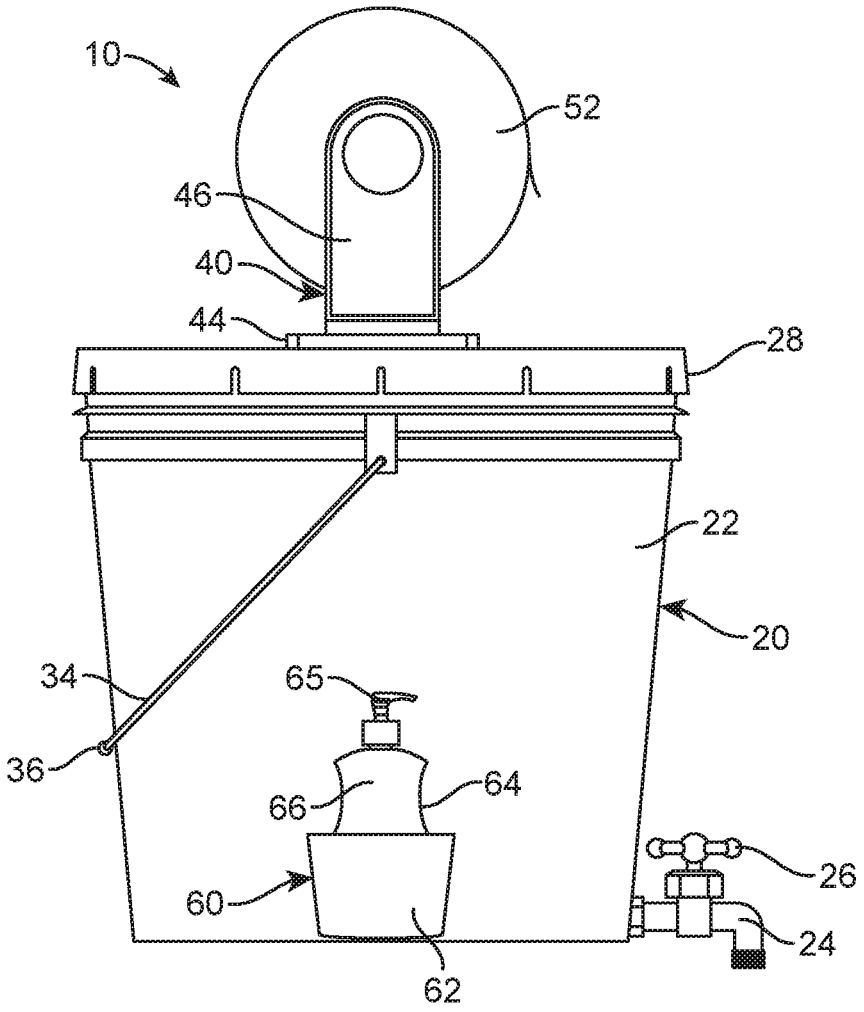
FIG. 7 shows a side view of the present invention.

Water reservoir assembly 20 may further include a carrying handle 34 mounted to water reservoir 22 at a predetermined location. Carrying handle 34 may be of a predetermined shape and dimensions as needed. Preferably, carrying handle 34 may be semicircular as seen in the immediate embodiment. It should be understood that carrying handle 34 may swivel or rotate about the mounting points at which carrying handle 34 mounts to water reservoir 22. It should be understood that carrying handle 34 may be made of metal, but other materials such as plastic, rubber, stainless steel or the like may be suitable as well. It can be seen that carrying handle 34 may include a handle grip 36 adapted to provide comfort to user U transporting the present invention with the use of carrying handle 34. Referring to FIG. 1, it can be seen how user U may transport the present invention with the help of carrying handle 34 and handle grip 36. Handle grip 36 may be made of rubber, plastic, cloth, or the like. Handle grip 36 may additional help user U to better grip carrying handle 34 upon transportation. Handle grip 36 may be centrally located on carrying handle 34. Referring to FIG. 5, it can be seen how carrying handle 34 may be mounted to water reservoir 22.

Washing station 10 may further include holder assembly 40. Holder assembly 40 may be mounted to water reservoir assembly 20. Holder assembly 40 may include a holder 42 that may be mounted to lid 28. In one embodiment, holder 42 may be mounted to lip 31. Holder 42 may extend across the diameter of lid 28. In one embodiment, holder 42 may be suspended across lip 31 as to be above the flat surface of lid 28. In one embodiment, holder 42 may extend beyond the outer edge of lip 31. Holder 42 may include a base 44 that may be directly mounted onto lid 28. Base 44 may be secured to lid 28 with the use of fasteners such as screws, nails, adhesives, hook and loop straps, buttons, snap buttons, suction cups or other fastening means as known in the art. Extending from base 44 may be a first arm 46 and a second arm 48. First arm 46 and second arm 48 may be of a predetermined shape and dimensions. First arm 46 and second arm 48 may be lowered or raised. When first arm 46 and second arm 48 are raised and erect, a paper towel roll 52 may be extended therebetween. First arm 46 and second arm 48 may include engaging members that protrude from each of first arm and second arm 48 to be able to engage paper towel roll 52. The engaging members may be at a distal end of each of first arm 46 and second arm 48. The engaging members of first arm 46 and second arm 48 may face towards each other. The engaging member may be of a dimension that cooperates with fitting into the top and bottom opening located on paper towel roll 52. Paper towel roll 52 may be of a predetermined shape and dimension that cooperates with fitting in holder 42, more specifically, between first arm 46 and second arm 48. It should be understood that paper towel roll 52 may be removably mounted to holder 42. Paper towel roll 52 may be used by user U to obtain a paper towel for drying of the hands of user U after the hands pf user U have been washed and cleaned. Paper towel roll 52 may be replaced once it has been emptied. When holder 42 is not in use, first arm 46 and second arm 48 may be lowered for storage. In one embodiment, first arm 46 and second arm 48 may be foldable. When first arm 46 and second arm 48 are stored away they may be stored in an arm storage opening 49 located on base 44 of holder 42. First arm 46 and second arm 48 may be folded until they are stored flush within arm storage opening 49. Arm storage opening 49 may be of a predetermined elongated shape. In one embodiment, arm storage opening 49 may be an elongated U shape. The number of arm storage opening 49 may correspond with the number of arms that holder 42 includes. As such the immediate embodiment, may include two of arm storage opening 49.

The present invention may also include soap dispenser assembly 60. Soap dispenser assembly may be mounted to water reservoir assembly 20. Soap dispenser assembly 60 may include a shelf 62 mounted to water reservoir 22 at a predetermined location. Preferably, in one embodiment, shelf may be mounted to the lower portion of water reservoir 22. It may be suitable for shelf 62 to be removably mounted to water reservoir 22. Shelf 62 may be mounted to water reservoir 22 with fasteners such as screws, nails, adhesives, hook and loop straps, buttons, snap buttons, suction cups or other fastening means as known in the art. In another embodiment, shelf 62 may be integral with water reservoir 22. Shelf 62 may be semicircular shaped. However, it should be understood that shelf 62 may be of a predetermined shape and dimensions. Held and stored within shelf 62 may be a soap dispenser 64. Soap dispenser 64 may be removably stored within shelf 62. Soap dispenser 64 may house soap 66 for user U to use with water W dispensed from water reservoir 22 for washing of the hands of user U, preferably. User U may dispense soap 66 by using pump 65 which is on soap dispenser 64. Pump 65 may be removably attached to soap dispenser 64 to allow for refilling of soap dispenser 64 when necessary. With the present invention the user may have clean water available even outdoors. Water W may be stored within water reservoir 22 and dispensed through spigot 24. User U may use soap 66 from soap dispenser 64 to thoroughly clean their hands. Afterwards, user U may use a paper towel from paper towel roll 52 to dry their hands after cleaning.

It should be understood that water reservoir 22 may be customized as per the desires and wishes of user U. Water reservoir 22 can be decorated as user U sees fit. The customization of water reservoir 22 allows user U to express their creativity and personality. It may also be suitable for water reservoir to be left blank as well.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a washing station, comprising:

a. a water reservoir assembly including a water reservoir having a spigot and a spigot knob mounted thereon, said water reservoir adapted to being filled with water, said water reservoir having an opening at a top end, said water reservoir including a lid mounted to said water reservoir at said top end covering said opening, said water reservoir having an open and closed configuration, said open configuration achieved when said lid is detached from said water reservoir;

b. a holder assembly including a holder, said holder having a base, said holder further including a first arm and a second arm extending from said base, a paper towel roll secured between said first arm and said second arm, said holder mounted to said lid; and c. a soap dispenser assembly including a shelf, said shelf mounted to said water reservoir, a soap dispenser secured on said shelf, said soap dispenser having soap stored therein, said soap dispenser having a pump to dispense said soap, a user dispenses soap on their hands to wash them along with water that is dispensed from the water reservoir with said spigot, said paper towel roll being used by said user for drying of said hands after washing.

2. The system of claim 1, wherein said lid includes a lip extending about a perimeter of said lid.

3. The system of claim 2, wherein said holder is mounted across the diameter of said lid and suspended across said lip.

4. The system of claim 1, wherein said lid includes a refill lid mounted to a refill opening on said lid.

5. The system of claim 4, wherein said refill opening is accessed by removing said refill lid, said refill opening permitting refilling of said water reservoir through said refill opening even when said lid is mounted to said water reservoir.

6. The system of claim 1, wherein said water reservoir assembly further includes a carrying handle mounted to said water reservoir.

7. The system of claim 6, wherein said carrying handle is mounted at an upper portion of said water reservoir, said carrying handle being semicircular.

8. The system of claim 6, wherein said carrying handle includes a handle grip centrally mounted thereto, said handle grip adapted to provide comfort to said user transporting said water reservoir through said carrying handle.

9. The system of claim 1, wherein said first arm and said second arm are foldable.

10. The system of claim 1, wherein said base includes arm storage openings thereon.

11. The system of claim 10, wherein said first arm and said second arm are folded and stored flushly within said storage arm openings when not in use.

12. A system for a washing station, comprising:

a. a water reservoir assembly including a water reservoir having a spigot and a spigot knob mounted thereon, said spigot and said spigot knob mounted at a lower portion of said water reservoir and about a perimeter of said water reservoir, said water reservoir adapted to being filled with water, said water reservoir having an opening at a top end, said water reservoir including a lid at said top end covering said opening, said water reservoir having an open and closed configuration, said open configuration achieved when said lid is detached from said water reservoir, said lid including a lip extending about a perimeter of said lid, said lid further including a refill lid and a refill opening, said refill lid being removable, said refill lid removed when said water reservoir needs refilling while said lid is attached and covering said opening, said water reservoir being cylindrical, said lid extending beyond the perimeter of said opening, said water reservoir assembly further including a carrying handle mounted at a top portion of said water reservoir, said carrying handle being semicircular, said carrying handle may pivot about mounting points at which said carrying handle mounted to said water reservoir, said carrying handle having a handle grip centrally mounted thereon to provide comfort to said user transporting said water reservoir;

b. a holder assembly including a holder, said holder having a base, said holder further including a first arm and a second arm extending from said base, a paper towel roll secured between said first arm and said second arm, said holder mounted to said lid, said base being extending a diameter of said lid and said lid being suspended across said lip, said holder including arm storage openings on said base, said first arm and said second arm being foldable and stored flushly within said arm storage openings when folded, said first arm and said second arm each including engaging members at distal ends thereof, said engaging members protruding from said first and second arm, said engaging members facing each other, said engaging members engage said paper towel roll to suspend said paper towel roll between said first and second arm, said paper towel roll being suspended above said lid; and c. a soap dispenser assembly including a shelf, said shelf mounted to said water reservoir, a soap dispenser secured on said shelf, said soap dispenser having soap stored therein, said soap dispenser having a pump to dispense said soap, a user dispenses soap on their hands to wash them along with water that is dispensed from the water reservoir with said spigot, said paper towel roll being used by said user for drying of said hands after washing.

* * * * *